US006205792B1

(12) United States Patent
Anderson

(10) Patent No.: US 6,205,792 B1
(45) Date of Patent: Mar. 27, 2001

(54) REFRIGERATOR INCORPORATING STIRLING CYCLE COOLING AND DEFROSTING SYSTEM

(75) Inventor: Ronald K. Anderson, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/428,057

(22) Filed: Oct. 27, 1999

(51) Int. Cl.[7] ..... F25B 9/00
(52) U.S. Cl. ..... 62/6; 62/151; 62/155
(58) Field of Search ..... 62/6, 151, 155

(56) References Cited

U.S. PATENT DOCUMENTS

| | | | |
|---|---|---|---|
| 3,698,182 | 10/1972 | Knoos . | |
| 3,812,682 | 5/1974 | Johnson . | |
| 4,397,155 | 8/1983 | Davey . | |
| 4,475,346 | 10/1984 | Young et al. . | |
| 4,543,793 | 10/1985 | Chellis et al. . | |
| 4,545,209 | 10/1985 | Young . | |
| 4,578,956 | 4/1986 | Young . | |
| 4,664,685 | 5/1987 | Young . | |
| 4,902,952 | 2/1990 | Lavery . | |
| 4,996,841 | 3/1991 | Meijer et al. . | |
| 5,079,924 | 1/1992 | Van der Broeck et al. . | |
| 5,095,700 | 3/1992 | Bolger . | |
| 5,284,022 | 2/1994 | Chung . | |
| 5,333,460 * | 8/1994 | Lewis et al. | 62/6 |
| 5,460,009 | 10/1995 | Wills et al. . | |
| 5,642,622 * | 7/1997 | Berchowitz et al. | 62/6 |
| 5,693,991 | 12/1997 | Hiterer et al. . | |
| 5,813,235 | 9/1998 | Peterson . | |
| 5,927,079 * | 7/1999 | Sekiya et al. | 62/6 |

FOREIGN PATENT DOCUMENTS

| | | |
|---|---|---|
| 405126427 | 5/1993 | (JP) . |
| 406050622 | 2/1994 | (JP) . |

* cited by examiner

*Primary Examiner*—Ronald Capossela
(74) *Attorney, Agent, or Firm*—Everett G. Diederiks, Jr.

(57) ABSTRACT

A refrigerator including a freezer compartment is provided with a Stirling cycle refrigeration system including a displacer located within the freezer compartment and an external compressor which is fluidly coupled to the displacer. An electronic controller is provided to adjust a time phase relationship between the compressor and the displacer to establish a first phase condition for cooling of the freezer compartment and a second phase condition for establishing a defrost cycle for the refrigerator. The electronic controller is responsive to operator control inputs and sensor inputs. The phase relationship between the compressor and displacer is changed by substantially 180° from the first phase condition to the second phase condition.

13 Claims, 2 Drawing Sheets

REFRIGERATOR INCORPORATING STIRLING CYCLE COOLING AND DEFROSTING SYSTEM

BACKGROUND OF THE INVENTION

1. Field of the Invention

The present invention pertains to the art of refrigerators and, more particularly, a refrigerator assembly incorporating a Stirling cycle refrigeration system, the operating phase of which can be electronically controlled to effect both cooling and defrosting of a freezer compartment of the refrigerator.

2. Discussion of the Prior Art

The Stirling cycle is a known type of efficient refrigeration cycle. Such a cycle functions by directing a working fluid through four repetitive operations, i.e., a heat addition operation at constant temperature, a constant volume heat rejection operation, a constant temperature heat rejection operation and a heat addition operation at constant volume. It has been previously proposed to utilize a Stirling cycle in a refrigeration system, particularly a heat pump system. However, it has also been proposed in the art to utilize a Stirling cycle for use in a refrigerator. Such a Stirling cycle arrangement would incorporate an expander having an associated expansion space piston and a pulsator which has an associated compression space piston. In a conventional Stirling cycle refrigeration system, the phase relationship between the expansion piston and the compression piston is determined by a mechanical coupling between the pistons. However, particularly in view of the desire to adjust the degree of refrigeration, it has also been proposed to electronically control the time phase relationship between the expansion and compression pistons in order to alter the cooling capacity of the overall system. That is, the phase relationship can be altered, such as by changing the driving frequency for the expander and compressor, in order to actually reduce the maximum cooling capacity.

Despite these advances, the use of Stirling cycle refrigeration systems has not been widely accepted, in part due to the fact that the electronic controls proposed for such Stirling cycle systems do not provide for all of the cycles incorporated in more conventional refrigeration systems. For instance, the prior art dealing with Stirling cycle refrigeration systems have not addressed providing an automatic defrosting operation. For this and other reasons, there exists a need in the art for an improved refrigerator incorporating a Stirling cycle refrigeration system which can be electronically controlled to perform multiple operations, including both cooling and defrost operations, automatically. In addition, there is need in the art for a compact Stirling cycle system for use in a refrigerator.

SUMMARY OF THE INVENTION

The present invention is directed to a refrigerator assembly incorporating a Stirling cycle refrigeration system which is electronically controlled in order to provide for both cooling and defrost cycles. More specifically, the refrigerator assembly includes a refrigerator cabinet within which defines at least a freezer compartment. The Stirling cycle refrigeration system includes a Stirling cycle compressor and a Stirling cycle displacer, with the compressor being mounted within the cabinet but outside of the freezer compartment and with the displacer being mounted within the freezer compartment. The electronic controller can alter the time phase relationship between the compressor and displacer in order to change the refrigerator between cooling and defrost cycles of operation.

In order to provide a compact arrangement, both the compressor and displacer are preferably formed as a housing within which is positioned a movable piston and from which projects various radially extending, spaced fins. The refrigerator is also provided with a fan which is adapted to blow air over the fins of the displacer within a freezer compartment, at least during cooling cycles. In the most preferred embodiment of the invention, a phase relationship between the compressor and displacer is changed by 180° automatically by the controller in order to switch between the cooling and defrost cycles of operation.

Additional objects, features and advantages of the present invention will become more readily apparent from the following detailed description of the preferred embodiment thereof when taken in conjunction with the drawings wherein like reference numerals refer to corresponding parts in the several views.

DETAILED DESCRIPTION OF THE PREFERRED EMBODIMENT

Figure 1:
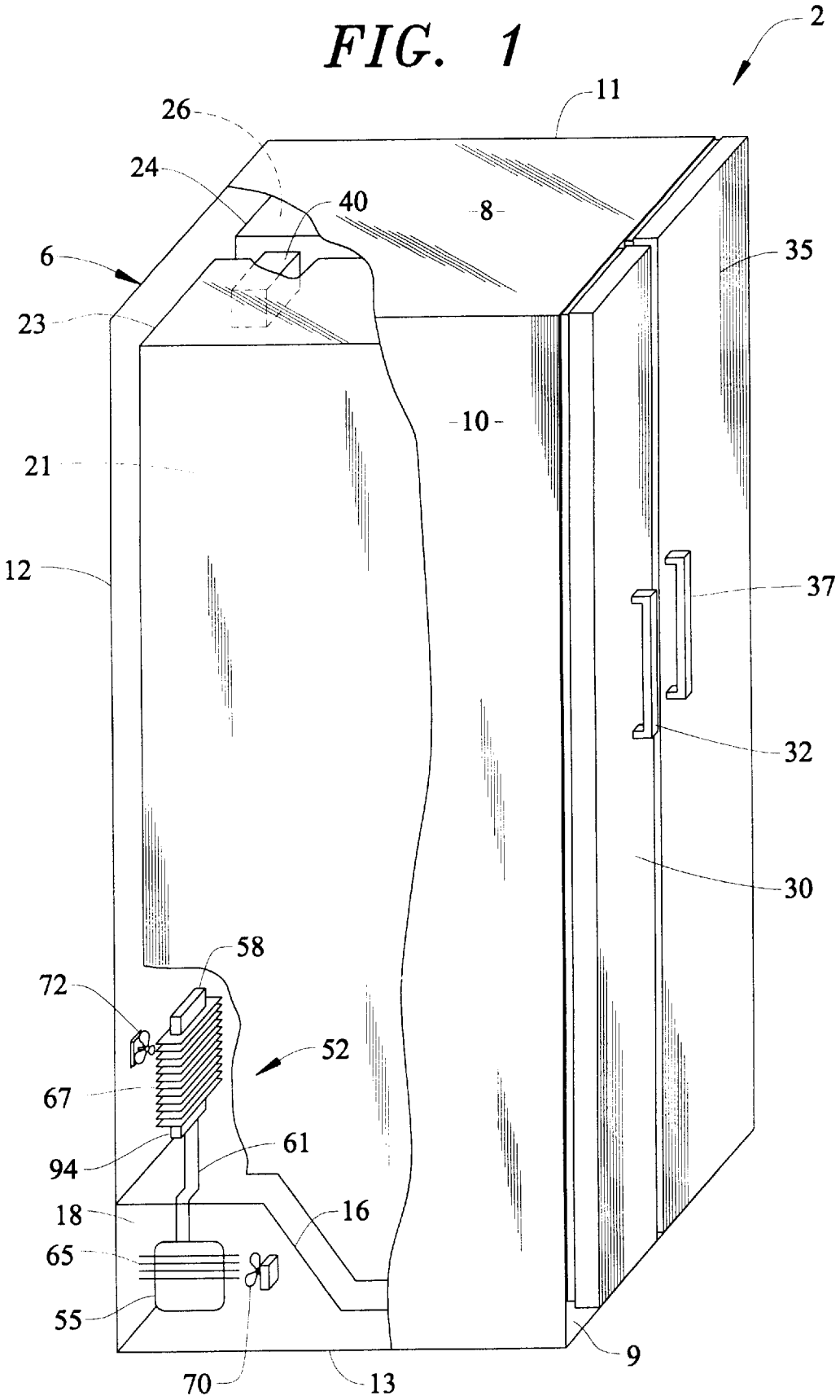
FIG. 1 is a partial cut-away left perspective view of a side-by-side refrigerator incorporating the Stirling cycle refrigeration system of the invention.

With initial reference to FIG. 1, a refrigerator constructed in accordance with the present embodiment is generally indicated at 2. Refrigerator 2 includes a cabinet 6 including top, front, side, rear and bottom wall portions 8–13. Positioned within cabinet 6, at a lower portion thereof, is an insert panel 16 that defines a lower rear chamber 18.

For purposes of this preferred embodiment, refrigerator 2 is shown to be a side-by-side refrigerator. However, at this point, it should be noted that the present invention is also applicable to other types of refrigeration units, including top-mount refrigerators and dedicated freezer units. In any event, as shown, refrigerator 2 includes a freezer compartment 21, generally defined by a liner 23 inserted into cabinet 6, and a fresh food compartment 26 which, in turn, is defined by a separate liner 24 inserted into cabinet 6. In the manner known in the art, liner 23 for freezer compartment 21 and liner 24 for fresh food compartment 26 are separated by a vertical mullion (not shown) and insulated foam is injected between cabinet 6 and the respective compartment liners 23 and 24. Furthermore, in a manner also known in the art, front portion 9 of cabinet 6 is provided with a freezer door 30 including a handle 32 for accessing freezer compartment 21, as well as a fresh food door 35 including a handle 37 for use in selectively accessing fresh food compartment 26. An air passageway 40 is shown to interconnect freezer compartment 21 to fresh food compartment 26 in order to enable a flow of cooling air from freezer compartment 21 to enter fresh food compartment 26. Although not shown, an automatic damper or other air flow control arrangement is preferably provided at air passageway 40 to regulate the amount of flow between freezer compartment 21 and fresh food compartment 26 based on operator set controls and one or more temperature sensors. Since such an air flow system is widely known in the art, it will not be discussed further here.

Figure 2:
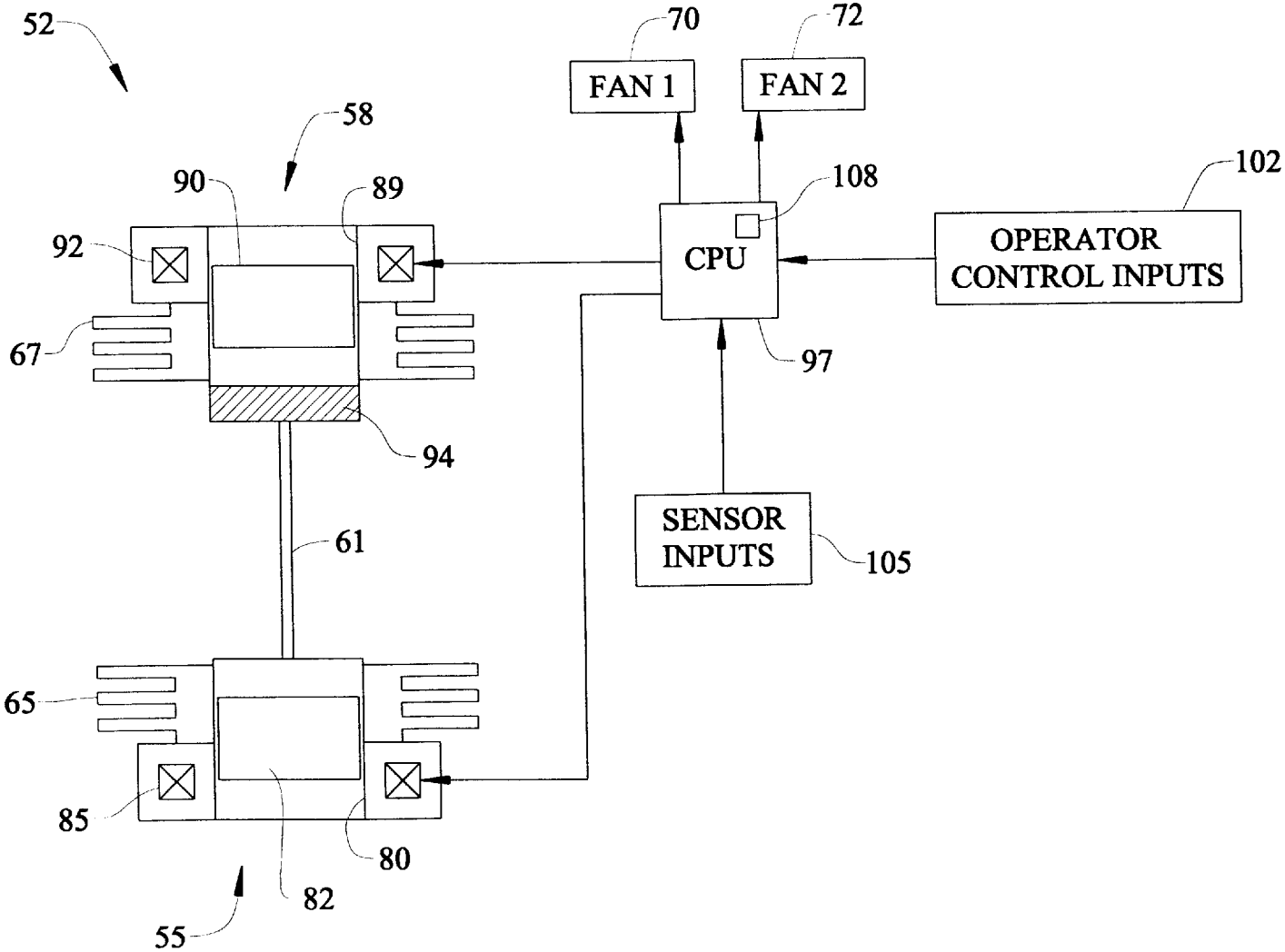
FIG. 2 is a schematic diagram of the refrigeration system constructed in accordance with the invention.

In accordance with the invention, refrigerator 2 incorporates a Stirling cycle refrigeration system generally indicated in both FIGS. 1 and 2 at 52. System 52 includes a Stirling cycle compressor 55 and a Stirling cycle displacer or expander 58 which are interconnected by a fluid coupling 61. Each of compressor 55 and displacer 58 have associated therewith heat exchange surfaces 65 and 67 respectively. In addition, the Stirling cycle refrigeration system 52 also includes a first fan 70 associated with compressor 55 and a second fan 72 associated with displacer 58 as will be more fully discussed below.

As perhaps best illustrated in FIG. 2, compressor 55 includes a housing 80 within which is shiftably mounted a piston 82. Compressor 55 also includes a phase altering actuator 85 which, in the preferred embodiment, takes the form of a linear motor. In a similar manner, displacer 58 includes a housing 89 within which is arranged a movable piston 90. Displacer 58 also has an associated actuator 92. As the general operation of a Stirling cycle is known in the art, including the use of linear motors to adjust the time phase relationship between a compressor and a displacer of a Stirling cycle system, these basic operation functions do not form part of the present invention and therefore will not be discussed further here. As further shown, a regenerator 94 is provided at displacer 58.

In order to maintain a rather compact arrangement for Stirling cycle refrigeration system 52, the heat exchange surfaces 65 of compressor 55 are preferably defined by a plurality of radially projecting, spaced fins which are formed as part of housing 80. In a similar manner, heat exchange surfaces 67 are formed as fins and extend from housing 89 of displacer 58. The arrangement of actuators 85 and 92 and heat exchange surfaces 65 and 67 of compressor 55 and displacer 58 make for an overall compact arrangement. In any event, as clearly shown in FIG. 1, compressor 55 is mounted within the lower rear chamber 18 and displacer 58 is mounted within freezer compartment 21. Again, compressor 55 and displacer 58 of Stirling cycle refrigeration system 52 are interconnected through a coupling 61 which extends through suitable apertures (not labeled) formed in insert panel 16 and freezer liner 23. First fan 70 is disposed adjacent compressor 55 for directing a flow of air over heat exchange surfaces 65 and second fan 72 is disposed adjacent displacer 58 for directing a flow of heat exchange surfaces 67.

Refrigerator 2 also incorporates a control arrangement for refrigeration system 52. In accordance with the most preferred embodiment of the invention, this control arrangement includes a central processing unit (CPU) 97 which is linked to both actuators 85 and 92, as well as fans 70 and 72. CPU 97 receives signals from operator control inputs at 102 and from sensor inputs 105. The operator inputs in accordance with the invention generally constitute temperature controls for establishing desired temperatures within freezer compartment 21 and fresh food compartment 26. The sensor inputs preferably include one or more temperature sensors associated with freezer compartment 21 and fresh food compartment 26. Furthermore, the CPU incorporates a timing unit 108, the function of which will be described more fully below.

During operation of the Stirling cycle refrigeration system 52 in a cooling mode, heat exchange surfaces 65 of compressor 55 will become heated while heat exchange surfaces 67 of displacer 58 will be cooled. Fan 70 is operated in accordance with the present invention to dissipate heat from compressor 55, while fan 72 is used to develop a flow of cooling air for use in freezing food products placed within freezer compartments 21, as well as cooling other food items placed within fresh food compartment 26. As known in connection with Stirling cycle systems, an optimum time phase relationship between the actions of piston 82 and piston 90 can be established to maximized the heat exchange between compressor 55 and displacer 58. A particular time phase relationship established for the invention is set by CPU 97 through actuators 85 and 92. The established time phase relationship will be set by CPU 97 dependent upon the signals received from operator control inputs 102 and sensor inputs 105, along with preset timing functions established in unit 108.

For the most part, it is desired to operate Stirling cycle refrigeration system 52 at its maximum efficiency to arrive at desired temperature settings for freezer compartment 21 and fresh food compartment 26. That is, the Stirling cycle refrigeration system 52 will operate until sensor inputs at 105 relay to CPU 97 that the temperatures selected at the operator control inputs 102 have been reached. During operation of the Stirling cycle refrigeration system 52, it is preferably desired to have first and second fans 70 and 72 simultaneously running. In this manner, an efficient cooling system for refrigerator 2 is presented.

In accordance with a particular aspect of the invention, CPU 97 can electronically alter the time phase relationship of compressor 55 and displacer 58 by substantially 180° such that the direction of heat flow between these components is reversed whereby refrigerator 2 can enter a defrost cycle. Therefore, in accordance with the present invention, the Stirling cycle refrigeration system 52 can function not only to efficiently cool refrigerator 2 but can be readily adjusted to establish a source of heat within freezer compartment 21 in order to perform a defrosting operation. In accordance with the most preferred embodiment of the invention, CPU 97 includes timer unit 108 which determines when a defrost cycle is entered. Other types of known arrangements for establishing a defrost cycle could also be utilized, such as ice accumulation sensors, adaptive defrost and the like.

Although described with respect to a preferred embodiment of the invention, it should be readily understood that various changes and/or modifications could be made to the invention without departing from the spirit thereof. In general, the invention is only intended to be limited by the scope of the following claims.

I claim:

1. A refrigerator assembly comprising:

a refrigerator cabinet within which is defined a freezer compartment;

a Stirling cycle refrigeration system including a Stirling cycle compressor and a Stirling cycle displacer, said Stirling cycle compressor being mounted within said cabinet but outside of the freezer compartment, said Stirling cycle displacer being mounted within the freezer compartment and being fluidly coupled to said Stirling cycle compressor, said Stirling cycle compressor and said Stirling cycle displacer incorporating respective pistons, said Stirling cycle displacer including a plurality of heat exchange surface portions;

means for electronically controlling a time phase relationship between said Stirling cycle compressor and said Stirling cycle displacer, said controlling means establishing a first phase condition, wherein the plurality of heat exchange surface portions of said Stirling cycle displacer are cooled, and a second phase condition, wherein the plurality of heat exchange surface portions of said Stirling cycle displacer are heated; and a fan for blowing air over the heat exchange surface portions of said Stirling cycle displacer within the freezer compartment such that, when the Stirling cycle refrigerator system is operating in the first phase condition, a flow of cooling air is directed through the freezer compartment and, when the Stirling cycle refrigeration system is operating in the second phase condition, a defrost cycle is established for the refrigerator.

2. The refrigerator assembly according to claim 1, wherein said controlling means includes means for automatically establishing the defrost cycle.

3. The refrigerator assembly according to claim 2, wherein said means for automatically establishing the defrost cycle comprises a timer.

4. The refrigerator assembly according to claim 1, wherein said Stirling cycle displacer includes a housing and said heat exchange surface portions are defined by spaced fins projecting from the housing.

5. The refrigerator assembly according to claim 1, wherein the controlling means includes a first phase altering actuator for said Stirling cycle compressor, a second phase altering actuator for said Stirling cycle displacer and an electronic controller linked to each of the first and second phase altering actuators.

6. The refrigerator assembly according to claim 5, wherein each of the first and second phase altering actuators comprises a linear motor.

7. The refrigerator assembly according to claim 1, wherein the Stirling cycle refrigeration system further includes a regenerator located at the Stirling cycle displacer within the freezer compartment.

8. The refrigerator assembly according to claim 1, wherein a phase relationship between the Stirling cycle compressor and the Stirling cycle displacer is changed by substantially 180° from a first phase condition to the second phase condition.

9. The refrigerator assembly according to claim 1, further comprising:

operator control input means for establishing a desired temperature for the freezer compartment, said operator control input means being connected to said controlling means.

10. The refrigerator assembly according to claim 9, further comprising:

sensor input means for signaling to said controlling means when a desired operating state is reached for the freezer compartment.

11. A method of cooling and defrosting a freezer compartment of a refrigerator comprising:

operating a Stirling cycle refrigeration system, including a displacer provided with a plurality of heat exchange surface portions located within the freezer compartment and a compressor located outside the freezer compartment, in a first phase condition wherein the plurality of heat exchange surface portions of the displacer are cooled for cooling of the freezer compartment; and operating the displacer and compressor of the Stirling cycle refrigeration system in a second phase condition wherein the plurality of heat exchange surface portions of the Stirling cycle displacer are heated in order to perform a refrigerator defrost cycle.

12. The method according to claim 11, further comprising:

operating a fan to create a flow of air over the heat exchange surface portions of the displacer.

13. The method according to claim 11, further comprising: changing a phase relationship between the compressor and displacer by substantially 180° from the first phase condition to the second phase condition.

* * * * *